US011768023B1

(12) United States Patent
Wei et al.

(10) Patent No.: US 11,768,023 B1
(45) Date of Patent: Sep. 26, 2023

(54) ICE CRUSHING DEVICE

(71) Applicant: Yunda H&HTech (Tianjin) Co., Ltd., Tianjin (CN)

(72) Inventors: Enyu Wei, Tianjin (CN); Xu Yang, Tianjin (CN); Hao Xu, Tianjin (CN); Yinping Yuan, Tianjin (CN)

(73) Assignee: Yunda H&HTech (Tianjin) Co., Ltd., Tianjin (CN)

( * ) Notice: Subject to any disclaimer, the term of this patent is extended or adjusted under 35 U.S.C. 154(b) by 0 days.

(21) Appl. No.: 17/659,896

(22) Filed: Apr. 20, 2022

(30) Foreign Application Priority Data

Mar. 16, 2022 (CN) ..... 202220568770.6

(51) Int. Cl.
*F25C 5/04* (2006.01)

(52) U.S. Cl.
CPC ..... *F25C 5/046* (2013.01)

(58) Field of Classification Search
CPC ..... F25C 5/046
USPC ..... 62/320
See application file for complete search history.

(56) References Cited

U.S. PATENT DOCUMENTS 83,048 A * 10/1868 Doane, Jr. ..... F25C 5/046 241/286
2,213,166 A * 8/1940 Majewski, Jr. ..... F25C 5/046 241/243
2,865,571 A * 12/1958 Ferdon ..... F25C 5/046 D7/374
4,252,002 A * 2/1981 Mullins, Jr. ..... F25C 5/24 285/402
2008/0157644 A1* 7/2008 Lee ..... F25C 5/22 62/344
2010/0313593 A1* 12/2010 Lee ..... F25C 5/22 62/320
2013/0174596 A1* 7/2013 Kim ..... F25C 5/00 62/320

* cited by examiner

*Primary Examiner* — Eric S Ruppert
*Assistant Examiner* — Kirstin U Oswald
(74) *Attorney, Agent, or Firm* — Todd R. Fronek; Larkin Hoffman Daly & Lindgren, Ltd.

(57) ABSTRACT

Disclosed is an ice crushing device, and relates to the field of ice crushing technology. The ice crushing device includes a conveying mechanism, a guide mechanism and an ice crushing mechanism. An upper end of the conveying mechanism is open and used for placing ice blocks, and a lower end of the conveying mechanism communicates with an upper end of the guide mechanism; a lower end of the guide mechanism communicates with an upper end of the ice crushing mechanism; the conveying mechanism is used for guiding the ice blocks into the guide mechanism, and the ice blocks in the guide mechanism fall into the ice crushing mechanism through the upper end of the ice crushing mechanism; and the ice crushing mechanism is used for crushing ice. The ice crushing device can improve the ice crushing efficiency and the ice crushing safety.

6 Claims, 5 Drawing Sheets

ICE CRUSHING DEVICE

TECHNICAL FIELD

The present disclosure relates to the field of ice crushing technology, and specifically relates to an ice crushing device.

BACKGROUND ART

At present, most ice makers in the household market make square ice, circular ice and the like. In many occasions, people need to crush ice, and square ice or circular ice is crushed through the ice crushing device.

Existing ice crushing devices adopt manual ice feeding, that is, ice blocks are manually fed into the ice crushing device to crush ice, so that continuous ice crushing is inconvenient, the ice crushing efficiency is low, and furthermore, certain danger exists.

SUMMARY

The present disclosure aims to provide an ice crushing device to solve the problems in the prior art, improve the ice crushing efficiency and the ice crushing safety.

In order to achieve the purpose, the present disclosure provides the following solution.

The present disclosure provides an ice crushing device, including a conveying mechanism, a guide mechanism and an ice crushing mechanism. An upper end of the conveying mechanism is open and configured for receiving ice blocks, and a lower end of the conveying mechanism is communicated with an upper end of the guide mechanism; a lower end of the guide mechanism is communicated with an upper end of the ice crushing mechanism; the conveying mechanism is configured for guiding the ice blocks into the guide mechanism, and the ice blocks in the guide mechanism fall into the ice crushing mechanism through the upper end of the ice crushing mechanism. The ice crushing mechanism is configured for crushing ice.

In some embodiments, the conveying mechanism includes a conveying shell, a spiral conveying piece and a driving piece for conveying. The driving piece for conveying is installed on an outer side wall of the conveying shell. The spiral conveying piece is located in the conveying shell. An output shaft of the driving piece for conveying extends into the conveying shell and is connected with an end of the spiral conveying piece. An other end of the spiral conveying piece extends to an opening in the upper end of the guide mechanism; and the driving piece for conveying is configured for driving the spiral conveying piece to rotate, and then the spiral conveying piece drives the ice blocks to move to the opening in the upper end of the guide mechanism.

In some embodiments, the spiral conveying piece is a spiral steel wire ring, and the driving piece for conveying is a gear motor.

In some embodiments, the guide mechanism is a slide way, a height of the slide way is gradually reduced in a direction from close to the conveying mechanism to away from the conveying mechanism, and baffle plates are fixed to two long edges of the slide way respectively.

In some embodiments, the ice crushing mechanism includes an ice crushing shell, a driving piece for ice crushing, a rotating shaft, fixed seats, a plurality of fixed blades and a plurality of rotating blades. A lower end of the ice crushing shell is open, and the fixed seats are installed on an inner side wall of the ice crushing shell. The fixed blades are installed on the fixed seats. The driving piece for ice crushing is installed on an outer side wall of the ice crushing shell, and the rotating shaft is rotatably installed on the inner side wall of the ice crushing shell. An output shaft of the driving piece for ice crushing extends into the ice crushing shell and is connected with an end of the rotating shaft; an other end of the rotating shaft is rotatably connected with the inner side wall of the ice crushing shell. The rotating blades are installed on a periphery of the rotating shaft; and when the driving piece for ice crushing operates, the rotating shaft and the rotating blades are driven to rotate, such that the rotating blades and the fixed blades are matched to crush ice.

In some embodiments, the fixed seats include two fixed seats, the two fixed seats are diagonally fixed in the ice crushing shell, the rotating blades are divided into two groups, and the two groups of rotating blades rotate to a position corresponding to the two fixed seats.

In some embodiments, inner walls of the fixed seats are arc-shaped curved surfaces.

In some embodiments, a side of each fixed blade away from the fixed seats is provided with sawteeth, and a side of each rotating blade is provided with sawteeth.

Compared with the prior art, the present disclosure has the following technical effects.

According to the ice crushing device provided by the present disclosure, the upper end of the conveying mechanism is open and used for placing ice blocks, and the lower end of the conveying mechanism communicates with the upper end of the guide mechanism; the lower end of the guide mechanism communicates with the upper end of the ice crushing mechanism; and the conveying mechanism is used for guiding the ice blocks into the guide mechanism. Compared with traditional manual ice feeding, the conveying mechanism and the slide way can temporarily store part of the ice blocks so as to achieve continuous ice crushing, thereby improving the ice crushing efficiency. The ice blocks in the guide mechanism can fall into the ice crushing mechanism through the upper end of the ice crushing mechanism so as to achieve the automatic ice feeding, thereby avoiding the situation that the use safety is affected due to the fact that the ice blocks are manually placed into the ice crushing mechanism.

BRIEF DESCRIPTION OF THE DRAWINGS

To more clearly illustrate the embodiments of the present disclosure or the technical solution in the prior art, the following briefly introduces the accompanying drawings to be used in the embodiments. Apparently, the accompanying drawings in the following description show merely some embodiments of the present disclosure, and those skilled in the art may still derive other drawings from these accompanying drawings without paying creative efforts.

Figure 1:
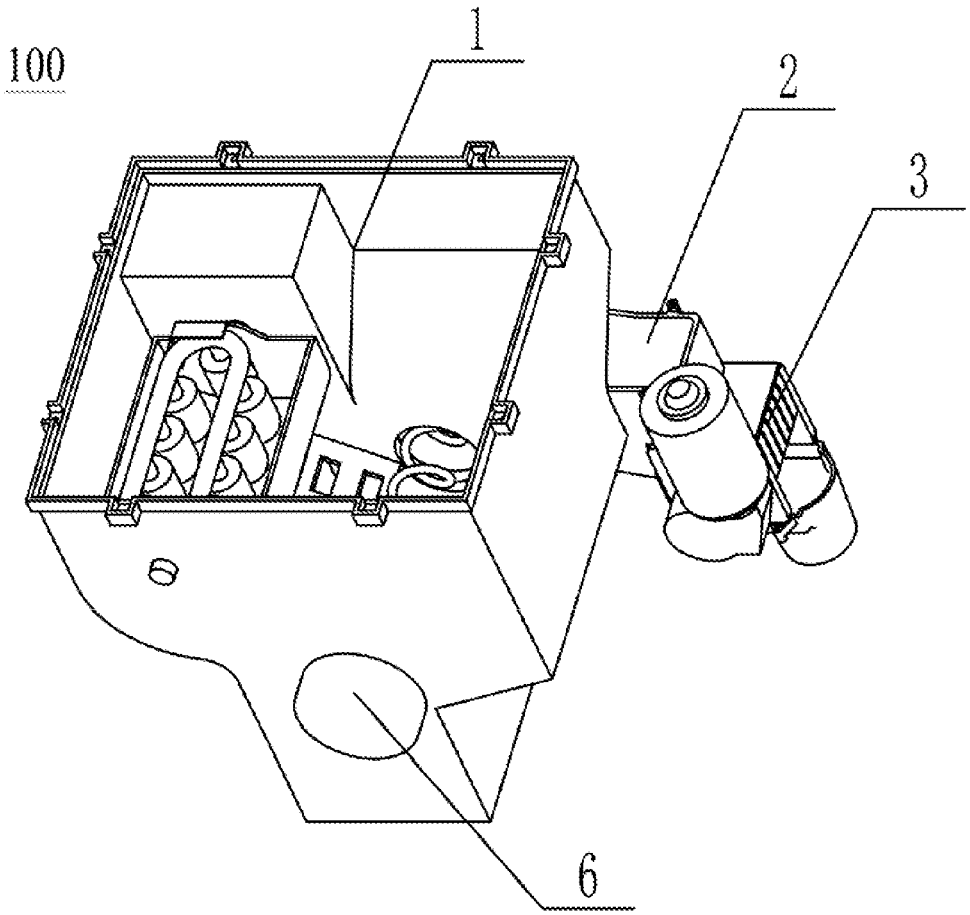
FIG. 1 is a schematic structural diagram of an ice crushing device, from a perspective, provided by the present disclosure.

Reference numerals: 100 ice crushing device; 1 conveying mechanism; 2 guide mechanism; 3 ice crushing mechanism; 4 ice block; 5 conveying shell; 6 driving piece for conveying; 7 spiral conveying piece; 8 baffle plate; 9 driving piece for ice crushing; 10 ice crushing shell; 11 rotating shaft; 12 fixed seat; 13 fixed blade; and 14 rotating blade.

DETAILED DESCRIPTION OF THE EMBODIMENTS

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. Based on the embodiments in the present disclosure, all other embodiments obtained by those skilled in the art without paying creative efforts belong to the scope protected by the present disclosure.

The present disclosure aims to provide an ice crushing device to solve the technical problems that an existing ice crushing device is low in ice crushing efficiency and low in safety.

To make the foregoing objectives, features and advantages of the present disclosure clearer and more comprehensible, the present disclosure is further described in detail below with reference to the accompanying drawings and specific embodiments.

Figure 2:
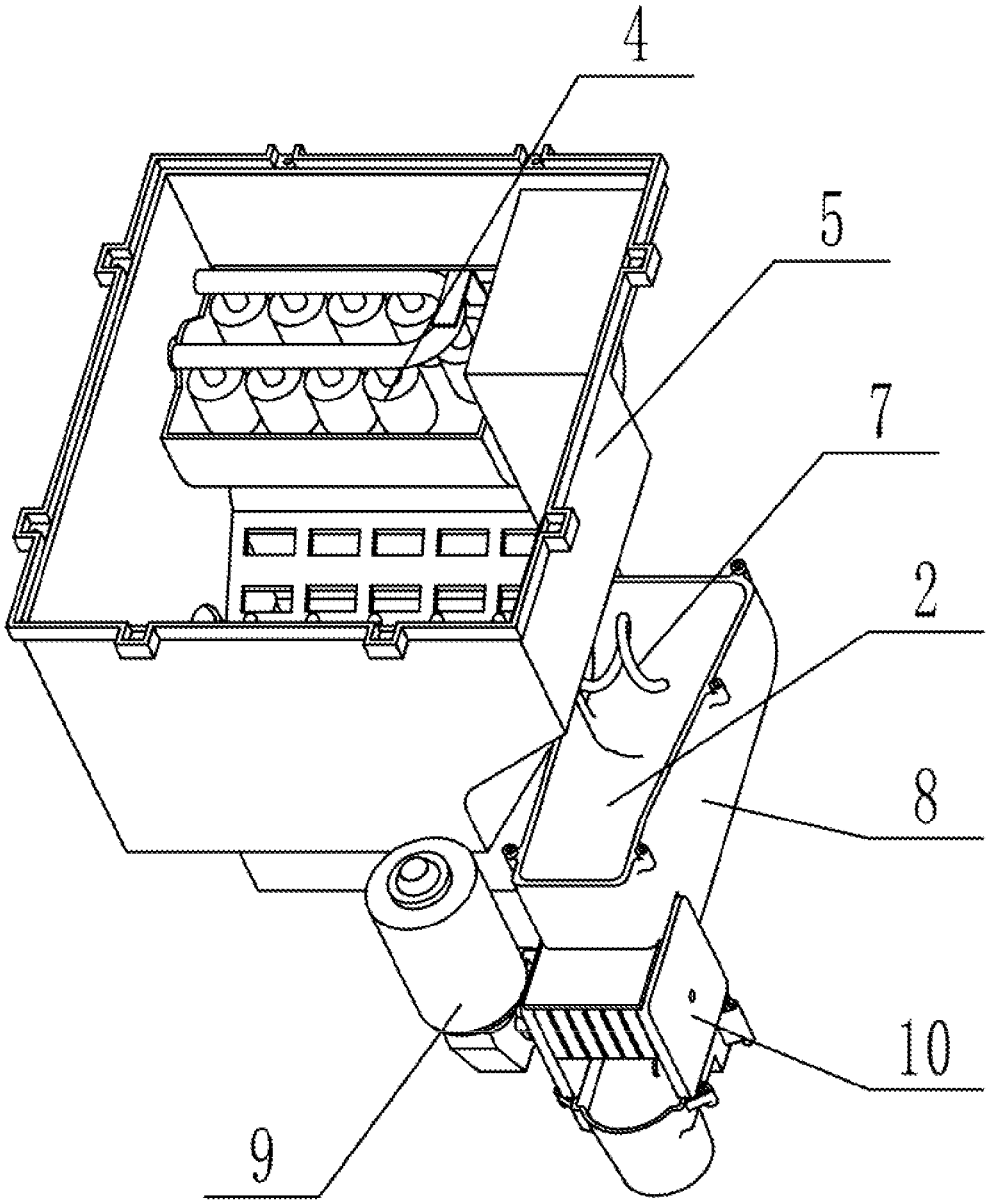
FIG. 2 is a schematic structural diagram of the ice crushing device, from another perspective, provided by the present disclosure.
Figure 3:
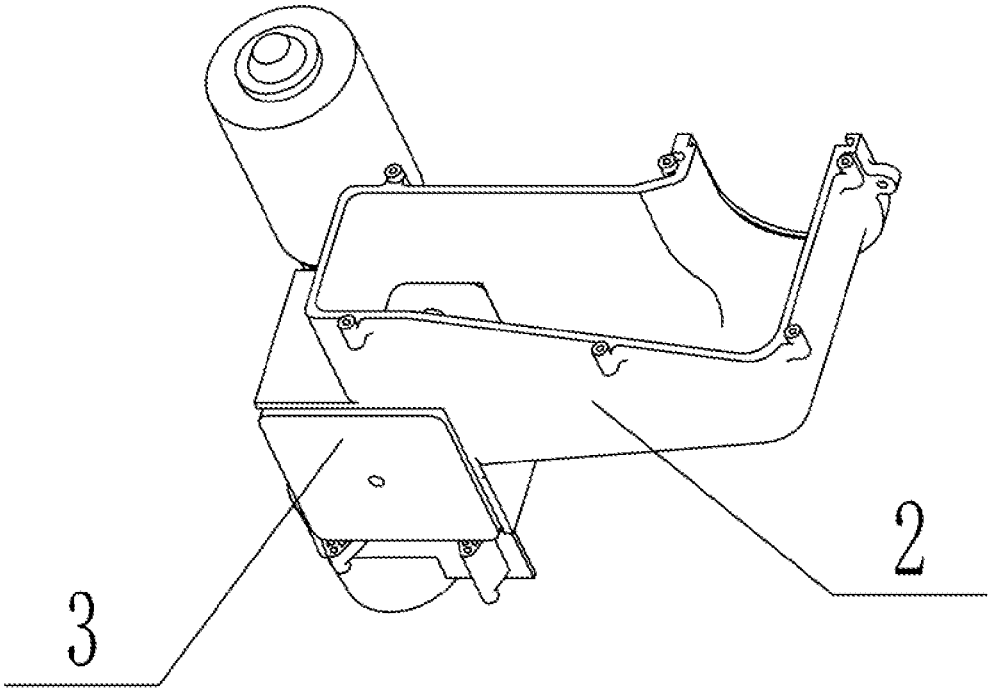
FIG. 3 is a schematic diagram showing matching of a guide mechanism and an ice crushing mechanism in the present disclosure.
Figure 4:
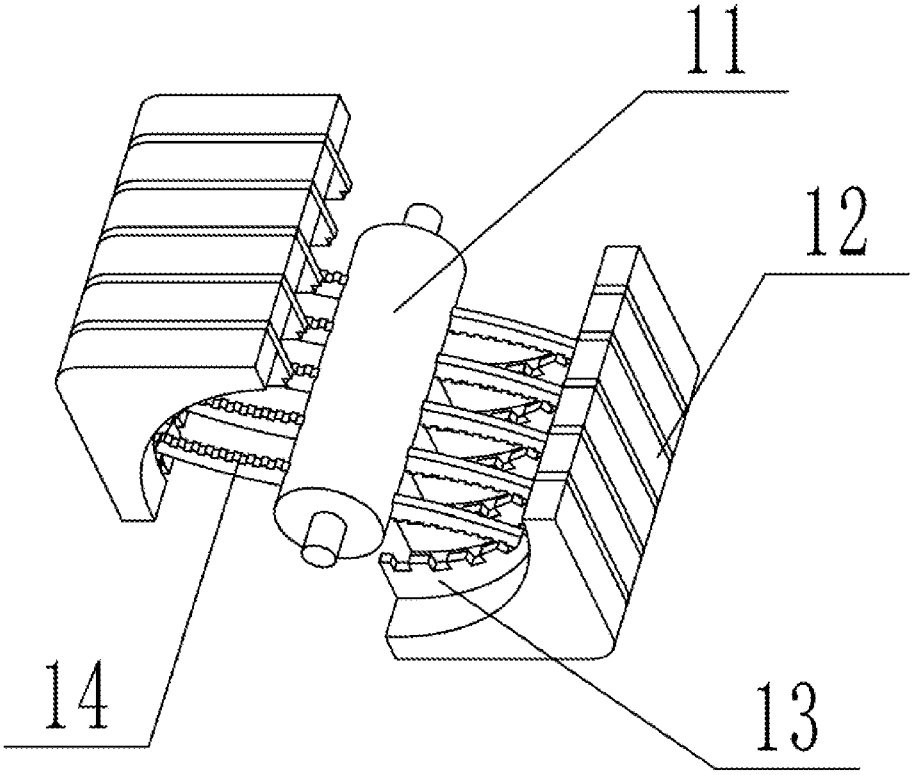
FIG. 4 is a schematic diagram of an internal structure of the ice crushing mechanism in the present disclosure.
Figure 5:
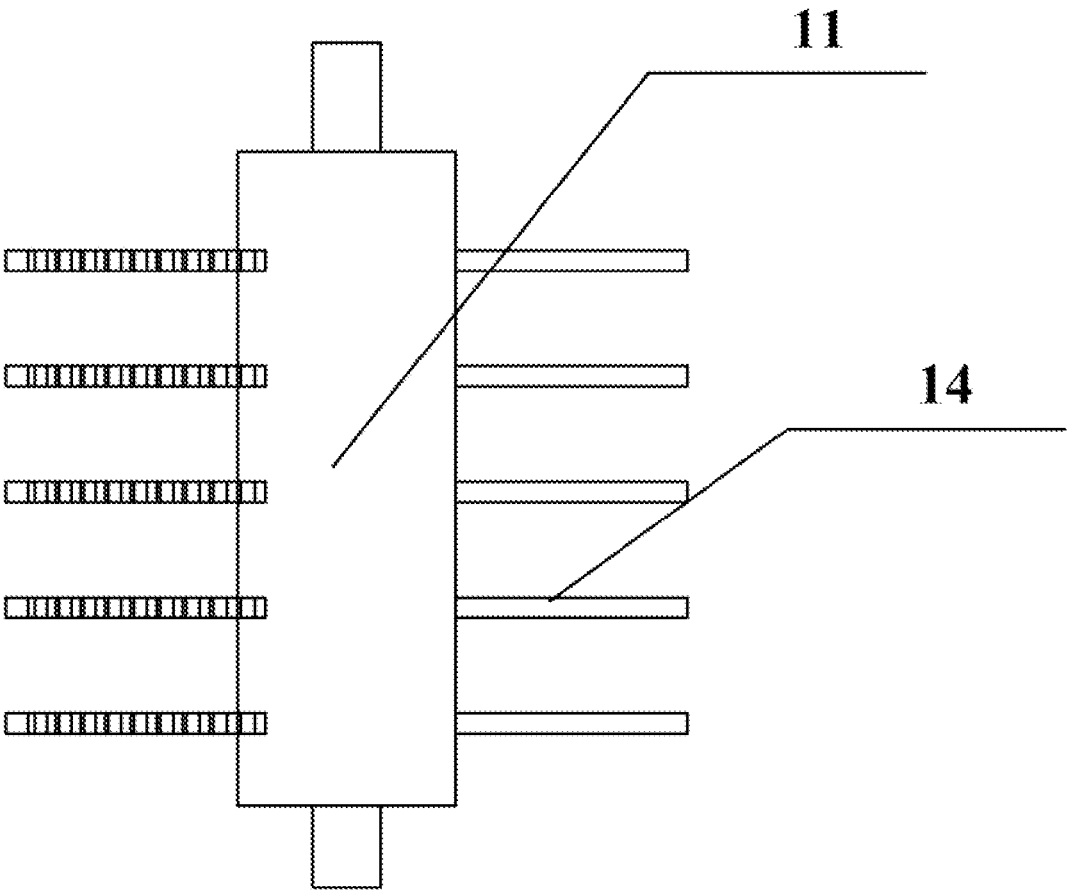
FIG. 5 is a front view of a rotating shaft and rotating blades in the present disclosure.
Figure 6:
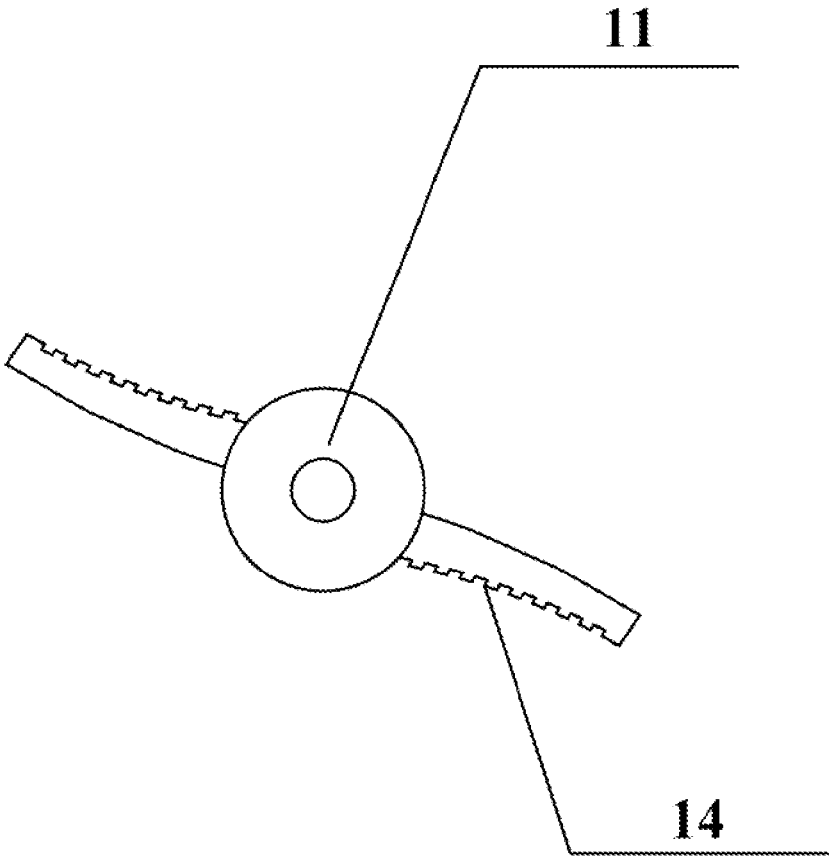
FIG. 6 is a side view of a rotating shaft and rotating blades in the present disclosure.

As shown in FIG. 1 to FIG. 6, the present disclosure provides an ice crushing device 100 which can match with water purification equipment combined with ice-making function, water drinking equipment combined with ice-making function, and an ice maker for use. The ice crushing device 100 includes a conveying mechanism 1, a guide mechanism 2 and an ice crushing mechanism 3. An upper end of the conveying mechanism 1 is open and is used for placing ice blocks 4, and a lower end of the conveying mechanism 1 communicates with an upper end of the guide mechanism 2; an lower end of the guide mechanism 2 communicates with an upper end of the ice crushing mechanism 3. The conveying mechanism 1 is used for guiding the ice blocks 4 into the guide mechanism 2. Compared with traditional manual ice feeding, the conveying mechanism 1 and a slide way can temporarily store part of the ice blocks 4, continuous ice crushing is achieved, thereby improving the ice crushing efficiency; and the ice blocks 4 in the guide mechanism 2 can fall into the ice crushing mechanism 3 through the upper end of the ice crushing mechanism 3, so that automatic ice feeding is achieved, thereby avoiding the situation that the use safety is affected due to the fact that the ice blocks 4 are manually placed into the ice crushing mechanism 3.

Specifically, the conveying mechanism 1 includes a conveying shell 5, a spiral conveying piece 7 and a driving piece for conveying 6. The driving piece for conveying 6 is installed on an outer side wall of the conveying shell 5 so as to drive the spiral conveying piece 7 to rotate. The spiral conveying piece 7 is located in the conveying shell 5; an output shaft of the driving piece for conveying 6 can stretch into the conveying shell 5 and is connected with one end of the spiral conveying piece 7; the other end of the spiral conveying piece 7 can extend to be above an opening in the upper end of the guide mechanism 2. The driving piece for conveying 6 is used for driving the spiral conveying piece 7 to rotate, and along with the rotation of the spiral conveying piece 7, the spiral conveying piece 7 can drive the ice blocks 4 to move towards an end away from the driving piece for conveying 6, and finally, the ice blocks 5 are moved to the opening in the upper end of the guide mechanism 2 and fall into the guide mechanism 2.

The spiral conveying piece 7 is a spiral steel wire ring and can realize transportation of the ice blocks 4, and is simple in structure and low in cost. The driving piece for conveying 6 is a gear motor, and thus the spiral conveying piece 7 is rotated at a low speed so as to drive the ice blocks 4 to move slowly.

The guide mechanism 2 is a slide way, and a height of the slide way is gradually reduced in a direction from close to the conveying mechanism 1 to away from the conveying mechanism 1, so that the ice blocks 4 automatically slide down into the ice crushing mechanism 3 under the effect of gravity; and baffle plates 8 are fixed to two long edges of the slide way respectively, so that two sides of the slide way are blocked, and the ice blocks 4 are avoided from dropping out.

The ice crushing mechanism 3 includes an ice crushing shell 10, a driving piece for ice crushing 9, a rotating shaft 11, a fixed seat 12, a plurality of fixed blades 13 and a plurality of rotating blades 14. The lower end of the ice crushing shell 10 is open so that it is convenient for the ice blocks 4 to come in and for crushed ice to guide out. The fixed seat 12 is installed on the inner side wall of the ice crushing shell 10; the fixed blades 13 are installed on the fixed seat 12 so as to facilitate matching with the rotary rotating blades 14 for crushing ice. The driving piece for ice crushing 9 is installed on the outer side wall of the ice crushing shell 10, which is convenient for the driving piece for ice crushing 9 to install. The rotating shaft 11 is rotatably installed on the inner side wall of the ice crushing shell 10; an output shaft of the driving piece for ice crushing 9 can stretch into the ice crushing shell 10 and is connected with one end of the rotating shaft 11. The other end of the rotating shaft 11 is rotatably connected with the inner side wall of the ice crushing shell 10. The rotating blades 14 are installed on a periphery of the rotating shaft 11 so as to drive the rotating blades 14 to rotate through the rotating shaft 11. When the driving piece for ice crushing 9 operates, the rotating shaft 11 and the rotating blades 14 can be driven to rotate, and then the rotating blades 14 and the fixed blades 13 are matched to extrude and crush the ice blocks 4, so that ice crushing is realized; and the opening in the lower end of the ice crushing shell 10 is used for discharging the crushed ice.

The number of the fixed seats 12 is two, the two fixed seats 12 are diagonally fixed in the ice crushing shell 10, the rotating blades 14 are divided into two groups, the two groups of rotating blades 14 can rotate to a position corresponding the two fixed seats 12, so as to improve the ice crushing efficiency.

The inner wall of the fixed seat 12 is an arc-shaped curved surface which can be matched with the rotary rotating blades 14 and convenient for the fixed blades 13 to install.

Sawteeth are arranged on a side, away from the fixed seat 12, of the fixed blade 13, and sawteeth are arranged on one side of the rotating blade 14, thereby facilitating ice crushing.

Specific examples are used for illustration of the principles and implementation methods of the present disclosure. The description of the above-mentioned embodiments is used to help understand the method and the core principles of the present disclosure; and meanwhile, those skilled in the art can make various modifications in terms of specific embodiments and scope of application in accordance with the teachings of the present disclosure. In conclusion, the content of this specification shall not be construed as a limitation to the present disclosure.

What is claimed is:

1. An ice crushing device, comprising a conveying mechanism, a guide mechanism and an ice crushing mechanism, wherein an upper end of the conveying mechanism is open and configured for receiving ice blocks, and a lower end of the conveying mechanism is communicated with an upper end of the guide mechanism; a lower end of the guide mechanism is communicated with an upper end of the ice crushing mechanism; the conveying mechanism is configured for guiding the ice blocks into the guide mechanism, and the ice blocks in the guide mechanism fall into the ice crushing mechanism through the upper end of the ice crushing mechanism; and the ice crushing mechanism is configured for crushing ice;

wherein the conveying mechanism comprises a conveying shell, a spiral conveying piece and a driving piece for conveying; the driving piece for conveying is installed on an outer side wall of the conveying shell; the spiral conveying piece is located in the conveying shell; an output shaft of the driving piece for conveying extends into the conveying shell and is connected with an end of the spiral conveying piece; an other end of the spiral conveying piece extends to an opening in the upper end of the guide mechanism; and the driving piece for conveying is configured for driving the spiral conveying piece to rotate, and then the spiral conveying piece drives the ice blocks to move to the opening in the upper end of the guide mechanism;

wherein the guide mechanism is a slide way, a height of the slide way is gradually reduced in a direction from close to the conveying mechanism to away from the conveying mechanism, and baffle plates are fixed to two long edges of the slide way respectively; the conveying mechanism and the ice crushing mechanism are arranged side-by-side, and an extension direction of the spiral conveying piece is perpendicular to an extension direction of the slide way.

2. The ice crushing device according to claim 1, wherein the spiral conveying piece is a spiral steel wire ring, and the driving piece for conveying is a gear motor.

3. The ice crushing device according to claim 1, wherein the ice crushing mechanism comprises an ice crushing shell, a driving piece for ice crushing, a rotating shaft, fixed seats, a plurality of fixed blades and a plurality of rotating blades; a lower end of the ice crushing shell is open, and the fixed seats are installed on an inner side wall of the ice crushing shell; the fixed blades are installed on the fixed seats; the driving piece for ice crushing is installed on an outer side wall of the ice crushing shell, and the rotating shaft is rotatably installed on the inner side wall of the ice crushing shell; an output shaft of the driving piece for ice crushing extends into the ice crushing shell and is connected with an end of the rotating shaft; an other end of the rotating shaft is rotatably connected with the inner side wall of the ice crushing shell; the rotating blades are installed on a periphery of the rotating shaft; and when the driving piece for ice crushing operates, the rotating shaft and the rotating blades are driven to rotate, such that the rotating blades and the fixed blades are matched to crush ice.

4. The ice crushing device according to claim 3, wherein the fixed seats comprise two fixed seats, the two fixed seats are diagonally fixed in the ice crushing shell, the rotating blades are divided into two groups, and the two groups of rotating blades rotate to a position corresponding to the two fixed seats.

5. The ice crushing device according to claim 3, wherein inner walls of the fixed seats are arc-shaped curved surfaces.

6. The ice crushing device according to claim 3, wherein a side of each fixed blade away from the fixed seats is provided with sawteeth, and a side of each rotating blade is provided with sawteeth.

* * * * *